US010810990B2

(12) United States Patent
Vogel et al.

(10) Patent No.: US 10,810,990 B2
(45) Date of Patent: Oct. 20, 2020

(54) ACTIVE NOISE CANCELLATION (ANC) SYSTEM WITH SELECTABLE SAMPLE RATES

(71) Applicant: Cirrus Logic International Semiconductor Ltd., Edinburgh (GB)

(72) Inventors: Gabriel Vogel, Austin, TX (US); Jeffrey Alderson, Austin, TX (US); Ryan A. Hellman, Austin, TX (US); Nitin Kwatra, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 94 days.

(21) Appl. No.: 16/261,775

(22) Filed: Jan. 30, 2019

(65) Prior Publication Data

US 2019/0237058 A1 Aug. 1, 2019

Related U.S. Application Data

(60) Provisional application No. 62/624,984, filed on Feb. 1, 2018.

(51) Int. Cl.
*G10K 11/178* (2006.01)

(52) U.S. Cl.
CPC .. *G10K 11/17854* (2018.01); *G10K 11/17815* (2018.01); *G10K 11/17823* (2018.01);
(Continued)

(58) Field of Classification Search
CPC ..... G10K 11/178; G10K 2210/3028; G10K 2210/3026; G10K 2210/108;
(Continued)

(56) References Cited

U.S. PATENT DOCUMENTS 5,341,249 A * 8/1994 Abbott ..... G11B 20/10 360/46
8,472,637 B2 * 6/2013 Carreras ..... G10L 21/0208 381/71.14

(Continued)

FOREIGN PATENT DOCUMENTS

EP 1970902 9/2008
EP 1970902 A2 * 9/2008 ..... G10L 21/02

(Continued)

OTHER PUBLICATIONS

Dieter, William R. et al. "Power Reduction by Varying Sampling Rate" *Low Power Electronics and Design*. 2005. ISLPED '05. Proceedings of the 2005 International Symposium on San Diego, CA, Aug. 8-10, 2005. pp. 227-232.

(Continued)

*Primary Examiner* — Lun-See Lao
(74) *Attorney, Agent, or Firm* — E. Alan Davis; James W. Huffman

(57) ABSTRACT

An active noise cancellation (ANC) system including a selectable decimation rate decimator that receives an over-sampled digital input and has an input that selects the decimation rate, a filter that receives an output of the decimator, and a selectable interpolation rate interpolator that receives an output of the filter and has an input that selects the interpolation rate. The selectable decimation rate decimator and the selectable interpolation rate interpolator operate to provide a selectable sample rate for the filter based on the selected decimation and interpolation rates. The filter may be an anti-noise filter, feedback filter, and/or a filter that models an acoustic transfer function of the ANC system. Rate selection may be static, or dynamically controlled based on battery or ambient noise level. A ratio of the decimation rate and the interpolation rate is fixed indepen- (Continued)

dent of the dynamically controlled decimation and interpolation rates.

20 Claims, 5 Drawing Sheets

(52) U.S. Cl.
CPC .. *G10K 11/17853* (2018.01); *G10K 11/17855* (2018.01); *G10K 2210/108* (2013.01); *G10K 2210/3026* (2013.01); *G10K 2210/3027* (2013.01); *G10K 2210/3028* (2013.01); *G10K 2210/3051* (2013.01)

(58) Field of Classification Search
CPC ..... G10K 2210/1081; G10K 11/17853; G10K 2210/3051; G10K 11/17885; G10K 11/17854; G10K 2210/3027; G10K 11/17873; G10K 11/17875; G10K 11/17879; G10K 11/17881; G10K 2210/3016; G10K 11/17827; G10K 2210/3012; G10K 2210/3017; G10K 2210/30231; G10K 2210/30232; G10K 2210/30391; G10K 2210/3055; G10K 2210/3226; G10K 2210/507; G10K 2210/508; G10K 2210/511; G10K 2210/512; G10K 11/17855; G10K 2210/1282; G10K 11/1785; G10K 2210/3022; G10K 2210/3033; H04R 1/1083; H04R 2460/01; H04R 3/005; H04R 2410/05; H04R 3/00; H04R 3/002; H04R 3/04; G10L 21/0208; G10L 21/0364; G10L 2021/02163; G10L 21/0216; H03M 1/001
USPC ..... 381/71.11–71.13, 92, 94, 1–94.5
See application file for complete search history.

(56) References Cited

U.S. PATENT DOCUMENTS

| | | | | |
|---|---|---|---|---|
| 9,020,157 | B2 | 4/2015 | Penketh et al. | |
| 9,324,311 | B1 | 4/2016 | Abdollahzadeh Milani et al. | |
| 9,430,999 | B2 | 8/2016 | Clemow | |
| 9,460,701 | B2 | 10/2016 | Yong et al. | |
| 9,462,376 | B2 | 10/2016 | Alderson | |
| 9,620,101 | B1 | 4/2017 | Thandri et al. | |
| 9,812,114 | B2 | 11/2017 | Alderson et al. | |
| 1,001,396 | A1 | 7/2018 | Kwatra et al. | |
| 10,013,966 | B2 | 7/2018 | Kwatra et al. | |
| 1,015,296 | A1 | 12/2018 | Hendrix et al. | |
| 10,152,960 | B2 | 12/2018 | Hebdrix et al. | |
| 2015/0195646 | A1* | 7/2015 | Kumar | G10K 11/17853 381/71.8 |
| 2015/0325229 | A1* | 11/2015 | Carreras | G10L 21/0208 381/71.6 |
| 2016/0365084 | A1* | 12/2016 | Alderson | H03H 17/0223 |
| 2019/0132679 | A1* | 5/2019 | Poulsen | G10L 21/0216 |

FOREIGN PATENT DOCUMENTS

| | | | |
|---|---|---|---|
| EP | 1970902 | A2 | 9/2008 |
| WO | WO2016198481 | A2 | 12/2016 |
| WO | PCT/US2019/015761 | | 1/2019 |

OTHER PUBLICATIONS

William R. Dieter, et al, "Power Reduction by Varying Sampling Rate", Low Power Electronics and Design, 2005. ISLPED '05. Proceedings of the 2005 International Symposium on San Diego, CA, USA Aug. 8-10, 2005, Piscataway, NJ, USA,IEEE, 2 Penn Plaza, Suite 701 New York NY 10121-0701 USA, Aug. 8, 2005, (Aug. 8, 2005), pp. 227-232, XP058264090, DOI: 10.1145/1077603.1077658 ISBN: 978-1-59593-137-5 the whole document.

* cited by examiner

ACTIVE NOISE CANCELLATION (ANC) SYSTEM WITH SELECTABLE SAMPLE RATES

CROSS REFERENCE TO RELATED APPLICATION(S)

This application claims priority based on U.S. Provisional Application Ser. No. 62/624,984, filed Feb. 1, 2018, entitled ANC SYSTEM WITH CONFIGURABLE SAMPLE RATES, which is hereby incorporated by reference in its entirety.

BACKGROUND

Portable audio devices, such as wireless telephones (e.g., mobile/cellular telephones, cordless telephones) and other consumer audio devices (e.g., mp3 players) are in widespread use. Performance of portable audio devices in terms of low power consumption is desirable. Performance of such devices with respect to intelligibility is also desirable. Intelligibility can be improved by providing noise canceling, such as active noise cancellation (ANC), using a microphone to measure ambient acoustic events and then using signal processing to insert an anti-noise signal into the output of the device to cancel the ambient acoustic events. ANC systems have strict latency requirements. That is, the anti-noise signal must arrive in time to cancel ambient noise. Longer anti-noise latency reduces ANC performance.

SUMMARY

In one embodiment, the present disclosure provides an active noise cancellation (ANC) system including a selectable decimation rate decimator that receives an oversampled digital input and has an input that selects the decimation rate, a filter that receives an output of the decimator, and a selectable interpolation rate interpolator that receives an output of the filter and has an input that selects the interpolation rate. The selectable decimation rate decimator and the selectable interpolation rate interpolator operate to provide a selectable sample rate for the filter based on the selected decimation and interpolation rates.

In another embodiment, the present disclosure provides a method performed by an active noise cancellation (ANC) system that includes a decimator receiving an oversampled digital input and a decimation rate selection, the decimator decimating the oversampled digital input at the selected decimation rate to generate an output at a selected sample rate based on the selected decimation rate, a filter filtering the output of the decimator at the selected sample rate to generate a filtered output, an interpolator receiving the filtered output and an interpolation rate selection, and the interpolator interpolating the filtered output at the selected interpolation rate.

DETAILED DESCRIPTION

Embodiments of an ANC system having a selectable sample rate for filter processing are described. A filter of the ANC system is respectively preceded and followed by a selectable decimation rate decimator and a selectable interpolation rate interpolator. The selectable decimation rate decimator and selectable interpolation rate interpolator operate to provide a selectable sample rate for the filter. Processing by the filter at a lower sampling rate may advantageously reduce power consumption in a portable device that includes the ANC system. However, the lower sampling rate may introduce additional latency in the ANC system. In one embodiment, the decimation and interpolation rates may be statically selected, e.g., based on the type of portable audio device in which the ANC system is employed. For example, a manufacturer may prioritize lower power consumption over higher noise cancellation in a product, in which case higher decimation and interpolation rates may be statically selected; whereas, in a different product, a manufacturer may prioritize higher noise cancellation over lower power consumption, in which case lower decimation and interpolation rates may be selected. In other embodiments, the decimation and interpolation rates may be dynamically controlled based on various factors, e.g., current battery level of the portable audio device, level of ambient noise, the ANC system is attempting to cancel, or a combination thereof. For example, if the battery level is low, the decimation and interpolation rates may be dynamically controlled to be high to reduce power consumption by the filters through lower sample rate processing; whereas, if the ambient noise is high, the decimation and interpolation rates may be dynamically controlled to be low to increase performance by the filters through reduced latency and higher sample rate processing. The ratio of the decimation rate and the interpolation rate is fixed independent of the dynamically selected decimation and interpolation rates. The filter may be an adaptive filter or a fixed filter, and may be an anti-noise filter, a feedback filter and/or a filter that models an acoustic transfer function of the ANC system. The ANC system may be a feedforward, feedback or hybrid ANC system. The ANC system may also include an additional delay in an adaptation update path to compensate for the selectable decimation/interpolation rate decimator/interpolator.

Figure 1A:
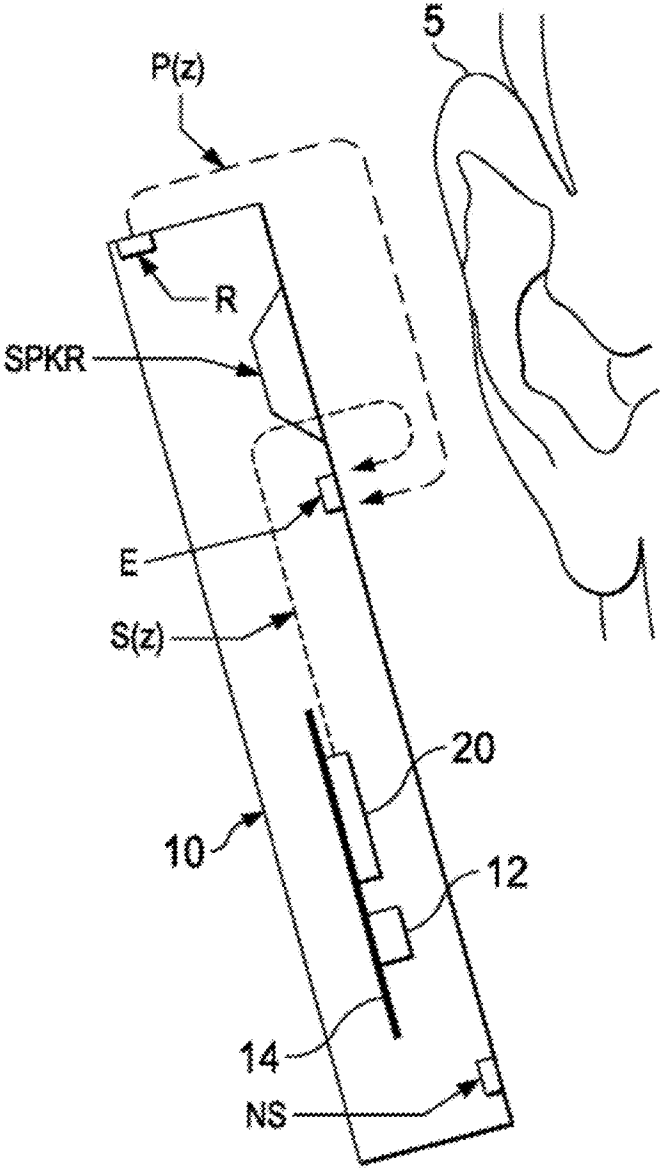
FIG. 1A is an illustration of an example wireless telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a portable audio device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant (s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the portable audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R.

Figure 1B:
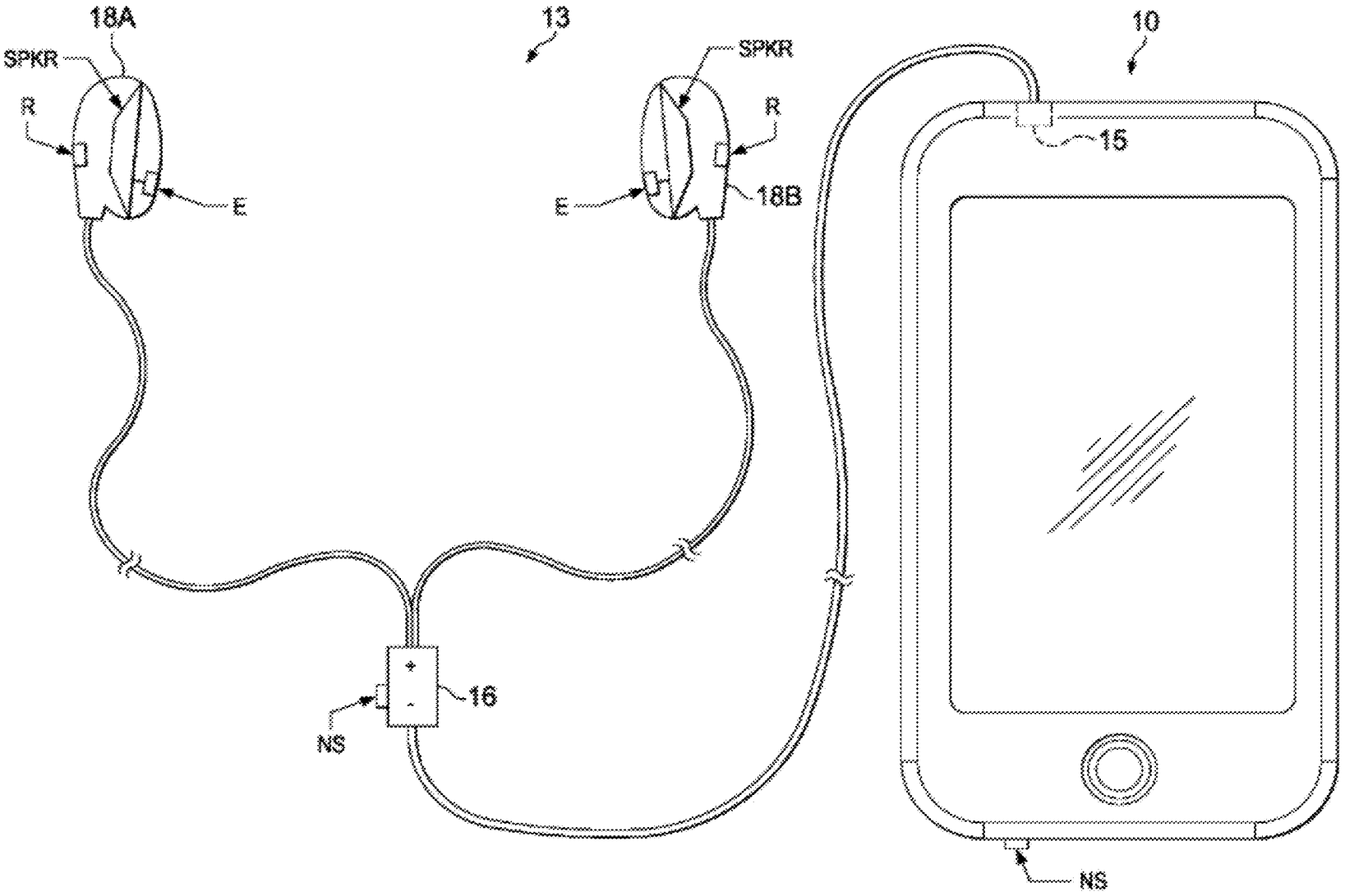
FIG. 1B is an illustration of an example wireless telephone with a headset assembly coupled thereto, in accordance with embodiments of the present disclosure.

Referring now to FIG. 1B, wireless telephone 10 is depicted having a headset assembly 13 coupled to it via audio port 15. Audio port 15 may be communicatively coupled to RF integrated circuit 12 and/or CODEC IC 20, thus permitting communication between components of headset assembly 13 and one or more of RF integrated circuit 12 and/or CODEC IC 20 (e.g., of FIG. 1A). In other embodiments, the headset assembly 13 may connect wirelessly to the wireless telephone 10, e.g., via Bluetooth or other short-range wireless technology. As shown in FIG. 1B, headset assembly 13 may include a combox 16, a left headphone 18A, and a right headphone 18B. As used in this disclosure, the term "headset" broadly includes any loudspeaker and structure associated therewith that is intended to be mechanically held in place proximate to a listener's ear canal, and includes without limitation earphones, earbuds, and other similar devices. As more specific examples, "headset" may refer to intra-concha earphones, supra-concha earphones, and supra-aural earphones.

Combox 16 or another portion of headset assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close a listener's ear when such headphone 18A, 18B is engaged with the listener's ear. In some embodiments, CODEC IC 20 may receive the signals from reference microphone R, near-speech microphone NS, and error microphone E of each headphone and perform adaptive noise cancellation for each headphone as described herein.

In other embodiments, a CODEC IC similar to CODEC ID 20 of FIG. 1A or another circuit may be present within headset assembly 13, communicatively coupled to reference microphone R, near-speech microphone NS, and error microphone E, and configured to perform adaptive noise cancellation as described herein. In such embodiments, an acoustic path having a transfer function P(z) that extends from the reference microphone R to the error microphone E similar to that described with respect to FIG. 1A may also exist with respect to the headset assembly 13. Additionally in such embodiments, an electro-acoustic path having a transfer function S(z) that represents the response of the audio output circuits of the CODEC IC of the headset assembly 13 and the acoustic/electric transfer function of speaker SPKR including the coupling between speaker SPKR and error microphone E, similar to those described with respect to FIG. 1A, may also exist with respect to the headset assembly 13.

Figure 2:
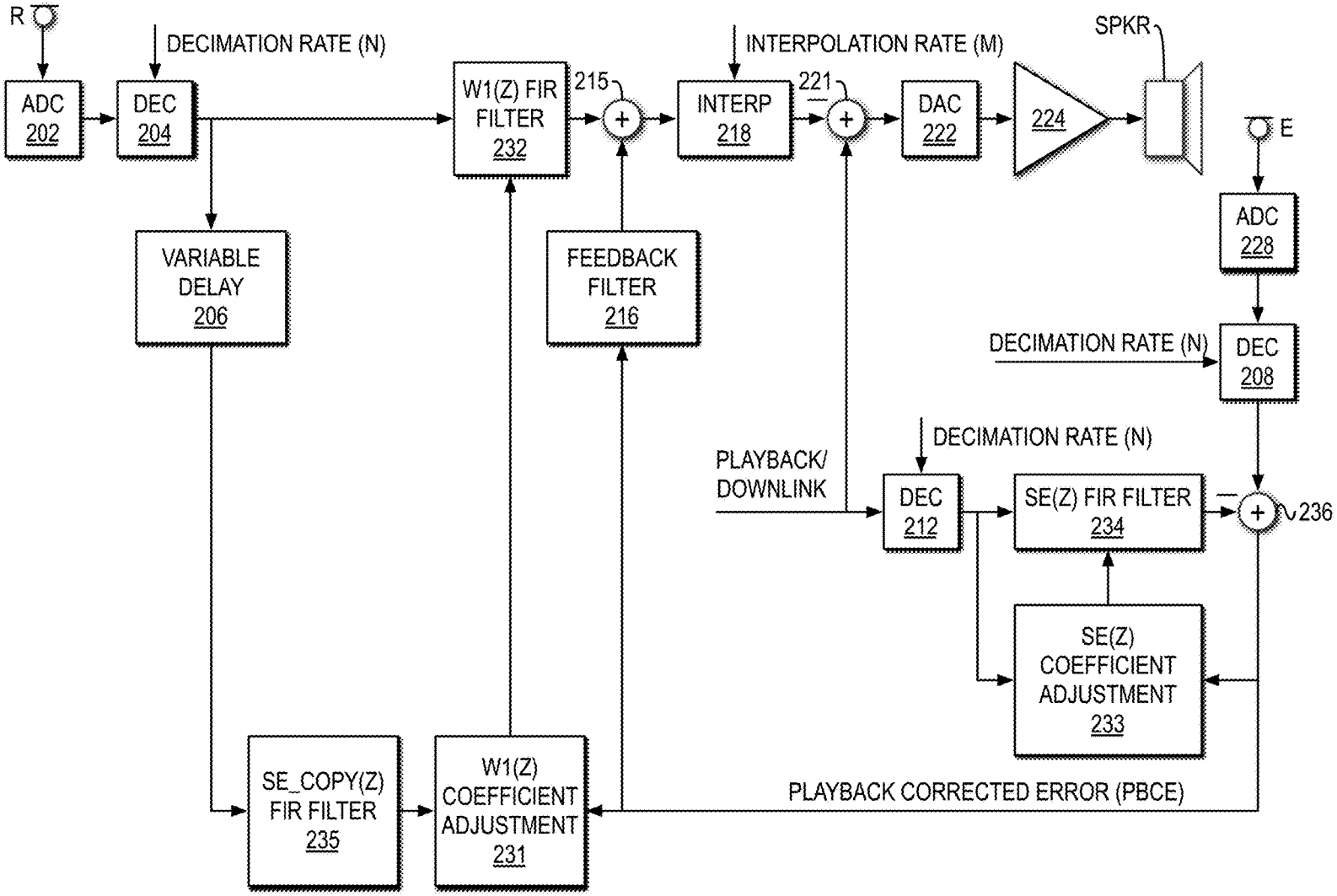
FIG. 2 is a block diagram illustrating details of an example ANC system in accordance with embodiments of the present disclosure.

Referring now to FIG. 2, details of an example ANC system 201 are shown in accordance with embodiments of the present disclosure. In some embodiments, ANC system 201 may be used to implement an ANC system in a portable audio device (e.g., wireless telephone 10 of FIG. 1A or headset assembly 13 of FIG. 1B). ANC system 201 includes a reference microphone R (e.g., reference microphone R of FIG. 1A or 1B) that transduces ambient audio into a reference microphone signal provided to an analog-to-digital converter (ADC) 202 that generates a digital representation of the reference microphone signal at a reference input sample rate. ANC system 201 also includes an error microphone E (e.g., error microphone E of FIG. 1A or 1B) that transduces ambient audio combined with the audio output by a speaker SPKR (e.g., SPKR of FIG. 1A or 1B) into an error microphone signal provided to a second ADC 228 that generates a digital representation of the error microphone signal at an error input sample rate. A first decimator 204 receives the digital representation of the reference microphone signal at the reference input sample rate and selectively reduces it to a reference output sample rate according to a decimation rate N indicated by a control input to decimator 204. Generally speaking, a decimator receives a digital input having a first sample rate and provides a digital output at a second sample rate that is less than the first sample rate. For example, if N is 4, then the output sample rate of the decimator is one-fourth its input sample rate. A second decimator 208 receives the digital representation of the error microphone signal at the error input sample rate and selectively reduces it to an error output sample rate according to the decimation rate N indicated by a control input to decimator 208. A third decimator 212 receives a digital playback/downlink signal at an input sample rate and selectively reduces it to an output sample rate according to the decimation rate N indicated by a control input to decimator 212. The input signal to the third decimator 212 may also include sidetone that is derived, for example, from a signal generated by a near-speech microphone (e.g., near-speech microphone NS of FIG. 1A or 1B). Preferably, decimators 204/208/212 receive their digital input signals at sample rates higher than the Nyquist rate, i.e., the digital input signals are oversampled. In one embodiment, the sample rate into each of decimators 204, 208 and 212 is the same and N is the same for all of decimators 204, 208 and 212 such that the sample rate out of each of decimators 204, 208 and 212 is the same. However, other embodiments are contemplated in which one or more of decimators 204, 208 and 212 has a different input sample rate and N is different for the one or more decimators 204, 208 and 212 such that the sample rate out of each of decimators 204, 208 and 212 is the same. For example, decimator 204 may have an input sample rate of 6 MHz and a decimation rate N of 8 such that its output sample rate is 750 kHz, decimator 208 may have an input sample rate of 3 MHz and a decimation rate N of 4 such that its output sample rate is 750 kHz, and decimator 212 may have an input sample rate of 1.5 MHz and a decimation rate N of 2 such that its output sample rate is 750 kHz. As described in more detail below, the selectable decimation rate N (in conjunction with a selectable interpolation rate M, described in more detail below) may advantageously enable digital filters (e.g., filters 232, 234, 235, 216, described below) of ANC system 201 to process at a lower sample rate and thereby reduce power consumption relative to processing at a higher sample rate in exchange for potentially reduced noise cancellation in designs and/or circumstances in which the reduced noise cancellation (e.g., due to increased latency) is acceptable.

An anti-noise filter 232 receives and filters the reference microphone signal from decimator 204 to generate an anti-noise signal provided to a combiner 215. The sample rate of the reference microphone signal received by anti-noise filter 232 is determined by the sample rate output by ADC 202 and by the decimation rate N selected for decimator 204. Filter 232 processes the reference microphone signal at the selectable sample rate output by decimator 204. Thus, filter 232 may consume less power if a higher decimation rate N is selected for decimator 204; however, more latency may be introduced by a higher decimation rate N, which may result in lower noise cancellation performance by ANC system 201 than if a lower decimation rate N is selected.

In the embodiment shown in FIG. 2, anti-noise filter 232 is an adaptive filter; however, in other embodiments anti-noise filter 232 is a fixed filter. In the embodiment shown in FIG. 2, anti-noise filter 232 is finite impulse response (FIR) filter having a transfer function W1($z$) and is referred to as W1($z$) FIR filter 232. Anti-noise filter 232 may adapt its transfer function W1($z$) to be P(z)/S(z), e.g., the transfer functions of the acoustic path P(z) and the electro-acoustic path S(z), respectively, of FIG. 1A or 1B. The coefficients of anti-noise filter 232 may be controlled by a W1($z$) coefficient adjustment block 231 that uses a correlation of signals from reference microphone R and error microphone E to determine the response W1($z$) of anti-noise filter 232, which generally minimizes the error, in a least-mean squares sense, between those components of the reference microphone signal present in the error microphone signal. Signals compared by W1($z$) coefficient adjustment block 231 may be a playback corrected error (PBCE) signal, which is based at least in part on the error microphone signal and described more below, and the reference microphone signal as shaped by a filter 235 (referred to in FIG. 2 as SE_COPY(z) FIR filter 235). Filter 235 is copy of a filter 234 (referred to in FIG. 2 as SE(z) FIR filter 234), which is an estimate, or model, of the acoustic transfer function of path S(z).

Filter 234 filters the playback/downlink signal to generate a signal that represents the expected playback/downlink audio delivered to error microphone E. The sample rate of the playback/downlink signal received by filter 234 is determined by the sample rate of the playback/downlink signal and by the decimation rate N selected for decimator 212. Filter 234 processes the playback/downlink signal at the selectable sample rate output by decimator 212. Thus, filter 234 may consume less power if a higher decimation rate N is selected for decimator 212.

A combiner 236 generates the PBCE signal by subtracting the expected playback/downlink audio signal produced by filter 234 from the error microphone signal—more precisely, a version of the error microphone signal whose sample rate is selectively reduced by decimator 208. The PBCE signal is provided to W1($z$) coefficient adjustment block 231, to a SE(z) coefficient adjustment block 233, and to a feedback filter 216. Filter 234 may have coefficients controlled by SE(z) coefficient adjustment block 233, which may compare the version of the playback/downlink signal whose sample rate is selectively reduced by decimator 212 and the PBCE signal. The PBCE signal is equal to the error microphone signal after removal of the playback/downlink signal as filtered by filter 234 to represent the expected playback/downlink audio delivered to error microphone E. Stated alternatively, the PBCE signal includes the content of the error microphone signal that is not due to the playback/downlink signal. SE(z) coefficient adjustment block 233 may correlate the playback/downlink signal with the components of the playback/downlink signal that are present in the error microphone signal and responsively adjust the coefficients of filter 234. Filter 234 may thereby be adapted to generate an estimated signal based on the playback/downlink signal that is subtracted from the error microphone signal to generate the PBCE signal.

Feedback filter 216 provides a filtered version of the PBCE signal to combiner 215. The sample rate of the PBCE signal received by feedback filter 216 is determined by the sample rate of the error microphone signal and by the decimation rate N selected for decimator 208. Feedback filter 216 processes the PBCE signal at the selectable sample rate output by decimator 208. Thus, feedback filter 216 may consume less power if a higher decimation rate N is selected for decimator 208; however, more latency may be introduced by a higher decimation rate N, which may result in lower noise cancellation performance by ANC system 201 than if a lower decimation rate N is selected.

Combiner 215 combines the filtered version of the PBCE signal and the anti-noise signal and provides a modified anti-noise signal to an interpolator 218. Generally speaking, an interpolator receives a digital input having a first sample rate and provides a digital output at a second sample rate that is greater than the first sample rate. Interpolator 218 increases the sample rate of the modified anti-noise signal according to an interpolation rate M indicated by a control input to interpolator 218. If M is 8 for example, then the output sample rate of interpolator 218 is eight times its input sample rate. A second combiner 221 subtracts the output of interpolator 218 from a playback/downlink signal to generate a digital anti-noise-carrying playback/downlink signal that is provided to a digital-to-analog converter (DAC) 222 that generates an analog representation of the noise-cancelled playback/downlink signal. The analog noise-cancelled playback/downlink signal is amplified by an amplifier 224 for provision to speaker SPKR.

In one embodiment, a variable delay 206 is introduced to the reference output sample rate reference microphone signal that is provided by decimator 204 to filter 235. Latency introduced from interpolator 218 and decimator 208 is a primary contribution affecting the amount of variable delay 206, which may be configurable. The ANC system 201 of FIG. 2 may be characterized as a hybrid ANC system since it includes both feedforward anti-noise (e.g., provided by adaptive filter 232) and feedback anti-noise (e.g., provided by filter 216). However, in other embodiments the ANC system may be simply a feedforward ANC system or a feedback ANC system.

Traditionally, filters of an ANC system may consume a relatively large amount of power. Advantageously, the amount of power consumed by the filters of embodiments of ANC systems described herein may be affected by selection of the decimation rate N and the interpolation rate M of a decimator and an interpolator, respectively, in between which one or more filters are interposed and which operate to provide a selectable input sample rate to the filters. As described above, the decimation rate N and the interpolation rate M are selectable rates, e.g., 1, 2, 4, 8. For example, if N is 4, then the output sample rate of the decimator is one-fourth its input sample rate, and a filter of the ANC system (e.g., anti-noise filter 232, feedback filter 216, and/or acoustic transfer function estimation filters 234 and 235 of FIG. 2) that receives the output of the decimator processes at the one-fourth output sample rate, thereby consuming less power than if the filter processed at the higher input sample rate. In one embodiment, the values of N and M need not be the same. In embodiments in which the values of N and M are dynamically selected, each time new values of N and M are selected, their ratios are kept the same. Larger values of N may be selected for lower sample rates and corresponding lower power consumption by filters of the ANC system 201 due to lower sample rate processing, which may result in lower intelligibility performance due to increased latency in the ANC system 201; whereas, smaller values of N may be selected for lower latency and higher intelligibility performance, which may result higher power consumption by the filters due to higher sample rate processing. Filters 232, 234, 235 and 216 each include an input (not shown) that specifies the input sample rate, which is a function of their respective selectable decimation rate N. In one embodiment, one or more of filters 232, 234, 235 and 216 are z' filters that automatically adjust their structure based on the specified sample rate such that their filter response remains constant independent of the selected sample rate.

Figure 3:
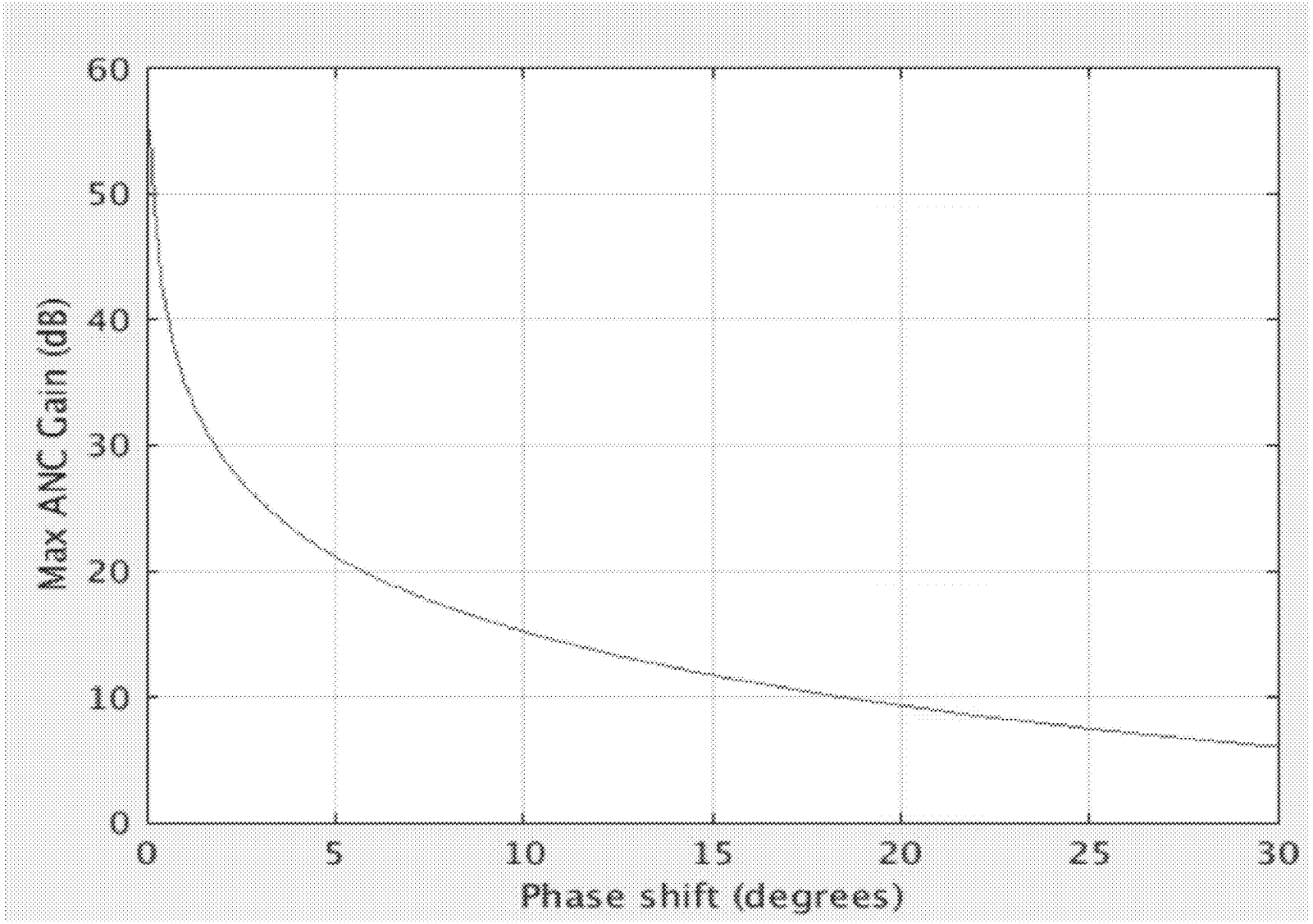
FIG. 3 is a graph illustrating an example of a relationship between ANC system gain and phase shift in accordance with embodiments of the present disclosure.

Referring now to FIG. 3, a graph illustrating an example of a relationship between ANC system gain and phase shift in accordance with embodiments of the present disclosure is shown. Phase shift measured in degrees is represented in the graph on the horizontal axis. Values of phase shift range between 0 and 30 degrees in the graph. Maximum ANC gain measured in decibels (dB) is represented in the graph on the vertical axis. Values of maximum ANC gain range between 0 dB and infinity in the graph. The phase shift, which is a measure of latency, represents the phase difference between the ambient noise received at the reference microphone (e.g., reference microphone R of FIG. 2) and the component of the audio generated by the speaker (e.g., speaker SPKR of FIG. 2) attributable to the anti-noise signal generated by the anti-noise filter (e.g., anti-noise filter 232 of FIG. 2). The phase shift may be caused at least in part by decimation and interpolation performed by decimators (e.g., decimators 204/208/212 of FIG. 2) and interpolators (e.g., interpolator 218 of FIG. 2) whose decimation/interpolation rates are selectable according to described embodiments. The maximum ANC gain represents the maximum level of ambient noise measured at the reference microphone (e.g., reference microphone R of FIG. 2) that the ANC system (e.g., ANC system 201 of FIG. 2) is able to cancel at the given phase shift. At zero degrees of phase shift, the maximum achievable ANC gain is infinite; however, as shown, as the phase shift approaches zero degrees (e.g., at approximately 0.1 degrees), the maximum achievable ANC gain is approximately 55 dB, and at 30 degrees of phase shift, the maximum achievable ANC gain is approximately 6 dB. The maximum gain values decrease from 0 degrees to 30 degrees in an approximately exponential fashion. As may be observed from FIG. 3, a larger selected decimation/interpolation rate of a decimator/interpolator in order to achieve a lower input sample rate to reduce power consumption by the interposed filters may accordingly reduce the amount of noise cancellation achievable by the ANC system.

Figure 4:
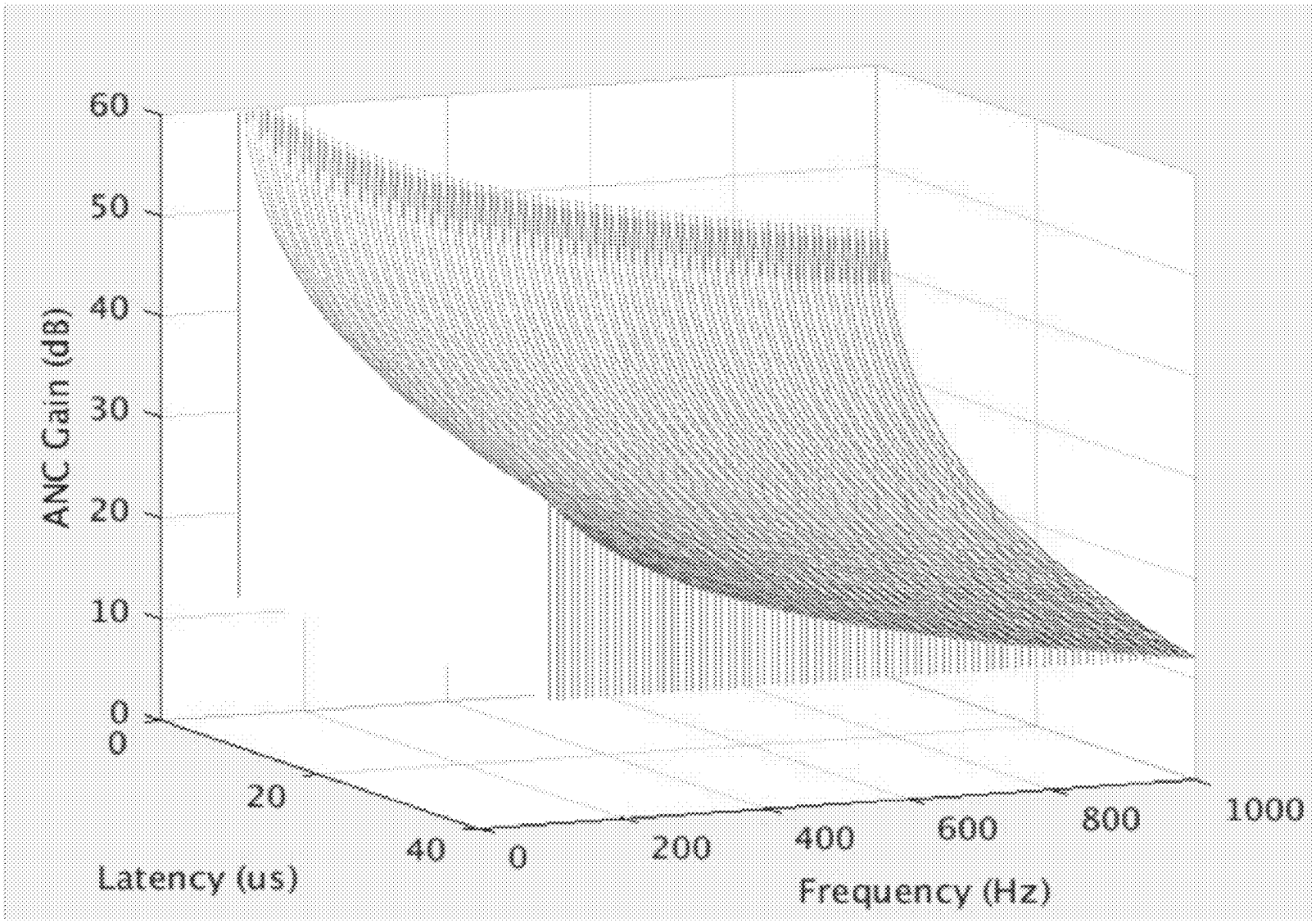
FIG. 4 is a 3-dimensional graph illustrating an example of a relationship between ANC system gain, latency and frequency in accordance with embodiments of the present disclosure.

Referring now to FIG. 4, a 3-dimensional graph illustrating an example of a relationship between ANC system gain, latency and frequency in accordance with embodiments of the present disclosure is shown. As in FIG. 3, maximum ANC gain measured in decibels (dB) is represented on the vertical axis, and values of maximum ANC gain range between 0 dB and infinity. Latency measured in microseconds (μs) is represented in the graph on one horizontal axis, values ranging between 0 and 40 microseconds. Frequency measured in Hertz (Hz) is represented on the other horizontal axis, values ranging from 0 Hz to 1000 Hz. Generally, the maximum achievable ANC gain decreases approximately exponentially as the latency increases, and the maximum achievable ANC gain decreases approximately exponentially as the frequency increases. Thus, as may be observed, latency becomes more critical at higher frequencies. At zero latency, the maximum achievable ANC gain is infinite. However, as the latency approaches zero microseconds (e.g., at approximately 0.1 degrees) at zero Hz, the maximum achievable ANC gain is approximately 60 dB; at 40 microseconds of latency and at 1000 Hz, the ANC system is limited to approximately 12 dB of cancellation. The limit includes both silicon latency and phase response of the speaker. Longer delays in the acoustic path P(z) that extend from the reference microphone to the error microphone may help in offsetting increased latency introduced by higher decimation rates. As may be observed from FIG. 4, a larger selected decimation/interpolation rate of a decimator/interpolator in order to achieve a lower input sample rate to reduce power consumption by the interposed filters may accordingly reduce the amount of noise cancellation achievable by the ANC system, particularly when the levels of the ambient noise are larger at higher frequencies.

As may be observed from the foregoing description, advantages of interposing one or more filters of an ANC system between a decimator and an interpolator having selectable decimation and interpolation rates, respectively, may be obtained. First, a single product may be configured as a high performance or a low power product. For example, a headset manufacturer may choose a selected configuration based on the power/performance goals for the headset. Second, the system may be dynamically changed. For example, when the ambient noise level is lower, performance of the ANC system may be reduced by dynamically lowering the decimation and interpolation rates since noise cancellation is not as badly needed, if at all. For another example, when the battery level of the portable audio device gets low, the battery time may be extended by reducing the ANC system performance by dynamically lowering the decimation and interpolation rates.

It should be understood—especially by those having ordinary skill in the art with the benefit of this disclosure—that the various operations described herein, particularly in connection with the figures, may be implemented by other circuitry or other hardware components. The order in which each operation of a given method is performed may be changed, unless otherwise indicated, and various elements of the systems illustrated herein may be added, reordered, combined, omitted, modified, etc. It is intended that this disclosure embrace all such modifications and changes and, accordingly, the above description should be regarded in an illustrative rather than a restrictive sense.

Similarly, although this disclosure refers to specific embodiments, certain modifications and changes can be made to those embodiments without departing from the scope and coverage of this disclosure. Moreover, any benefits, advantages, or solutions to problems that are described herein with regard to specific embodiments are not intended to be construed as a critical, required, or essential feature or element.

Further embodiments likewise, with the benefit of this disclosure, will be apparent to those having ordinary skill in the art, and such embodiments should be deemed as being encompassed herein. All examples and conditional language recited herein are intended for pedagogical objects to aid the reader in understanding the disclosure and the concepts contributed by the inventor to furthering the art and are construed as being without limitation to such specifically recited examples and conditions.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. An active noise cancellation (ANC) system, comprising:

a selectable decimation rate decimator that receives an oversampled digital input and has an input that selects the decimation rate;

a filter that receives an output of the decimator;

a selectable interpolation rate interpolator that receives an output of the filter and has an input that selects the interpolation rate;

wherein the selectable decimation rate decimator and the selectable interpolation rate interpolator operate to provide a selectable sample rate for the filter based on the selected decimation and interpolation rates;

wherein when the selected sample rate is a first sample rate that is less than a second sample rate, the filter consumes less power than when the selected sample rate is the second sample rate; and wherein when the selected sample rate is the second sample rate, the filter performs better noise cancellation than when the selected sample rate is the first sample rate.

2. The ANC system of claim 1, wherein the filter is an adaptive filter.

3. The ANC system of claim 2, wherein the ANC system further comprises an additional delay in one or more adaptation update paths to compensate for the selectable decimation rate decimator and the selectable interpolation rate interpolator.

4. The ANC system of claim 1, wherein the filter is a fixed filter.

5. The ANC system of claim 1, wherein the ANC system is one among the following: a feedforward ANC system, a feedback ANC system, and a hybrid ANC system.

6. The ANC system of claim 1, wherein the filter is one among the following: an anti-noise filter, a feedback filter, and a filter that models an acoustic transfer function of the ANC system.

7. The ANC system of claim 1, wherein the decimation and interpolation rates are statically selected for the ANC system.

8. The ANC system of claim 1, wherein the decimation and interpolation rates are dynamically controlled; and wherein a ratio of the decimation rate and the interpolation rate is fixed independent of the selected decimation and interpolation rates.

9. The ANC system of claim 8, wherein the decimation and interpolation rates are dynamically controlled based on a battery level in a portable device comprising the ANC system.

10. The ANC system of claim 8, wherein the decimation and interpolation rates are dynamically controlled based on a level of ambient noise that the ANC system attempts to cancel.

11. A method performed by an active noise cancellation (ANC) system, comprising:

receiving, by a decimator, an oversampled digital input and a decimation rate selection;

decimating, by the decimator, the oversampled digital input at the selected decimation rate to generate an output at a selected sample rate based on the selected decimation rate;

filtering, by a filter, the output of the decimator at the selected sample rate to generate a filtered output;

receiving, by an interpolator, the filtered output and an interpolation rate selection; and interpolating, by the interpolator, the filtered output at the selected interpolation rate;

wherein when the selected sample rate is a first sample rate that is less than a second sample rate, said filtering by the filter consumes less power than when the selected sample rate is the second sample rate; and wherein when the selected sample rate is the second sample rate, said filtering by the filter performs better noise cancellation than when the selected sample rate is the first sample rate.

12. The method of claim 11, wherein the filter is an adaptive filter.

13. The method of claim 12, further comprising:

adding delay in one or more adaptation update paths of the ANC system to compensate for the selectable decimation rate decimator and the selectable interpolation rate interpolator.

14. The method of claim 11, wherein the filter is a fixed filter.

15. The method of claim 11, wherein the ANC system is one among the following: a feedforward ANC system, a feedback ANC system, and a hybrid ANC system.

16. The method of claim 11, wherein the filter is one among the following: an anti-noise filter, a feedback filter, and a filter that models an acoustic transfer function of the ANC system.

17. The method of claim 11, wherein the decimation and interpolation rates are statically selected for the ANC system.

18. The method of claim 11, wherein the decimation and interpolation rates are dynamically controlled; and wherein a ratio of the decimation rate and the interpolation rate is fixed independent of the selected decimation and interpolation rates.

19. The method of claim 18, wherein the decimation and interpolation rates are dynamically controlled based on a battery level in a portable device comprising the ANC system.

20. The method of claim 18, wherein the decimation and interpolation rates are dynamically controlled based on a level of ambient noise that the ANC system attempts to cancel.

* * * * *